US005507316A

United States Patent [19]

Meyer

[11] Patent Number: 5,507,316

[45] Date of Patent: Apr. 16, 1996

[54] ENGINE HYDRAULIC VALVE ACTUATOR SPOOL VALVE

[75] Inventor: Lawrence L. Meyer, Northville, Mich.

[73] Assignee: Eaton Corporation, Cleveland, Ohio

[21] Appl. No.: 306,794

[22] Filed: Sep. 15, 1994

[51] Int. Cl.[6] ..... F15B 13/044

[52] U.S. Cl. ..... 137/625.65; 123/90.12; 137/625.68; 251/129.21

[58] Field of Search ..... 123/90.11, 90.12, 123/90.13; 137/625.65, 625.68; 251/129.21

[56] References Cited

U.S. PATENT DOCUMENTS

| | | | |
|---|---|---|---|
| 2,985,566 | 5/1961 | Tslen et al. | 251/368 X |
| 3,060,970 | 10/1962 | Aslan | 251/368 X |
| 3,580,287 | 5/1971 | McLaughlin | 137/625.69 |
| 4,513,780 | 4/1985 | Evans | 137/625.65 |
| 4,515,345 | 5/1985 | Inden et al. | 251/129.15 |
| 4,655,254 | 4/1987 | Hafner et al. | 137/625.65 |
| 5,005,803 | 4/1991 | Fritz et al. | 251/129.21 X |
| 5,011,113 | 4/1991 | Stobbs et al. | 251/129.21 X |
| 5,038,826 | 8/1991 | Kabai et al. | 137/625.65 |

*Primary Examiner*—Gerald A. Michalsky
*Attorney, Agent, or Firm*—Loren H. Uthoff, Jr.

[57] ABSTRACT

A lightweight spool valve for an engine hydraulic valve actuator having a lightweight main body with a center bore therethrough with one end plugged to balance hydraulic forces and a soft iron magnetic ring attached to the main body where the magnetic sleeve is castellated to minimize oil film stiction forces and magnetically interacts with an electrical coil which induces axial motion to control the flow of hydraulic oil within the valve actuator.

6 Claims, 2 Drawing Sheets

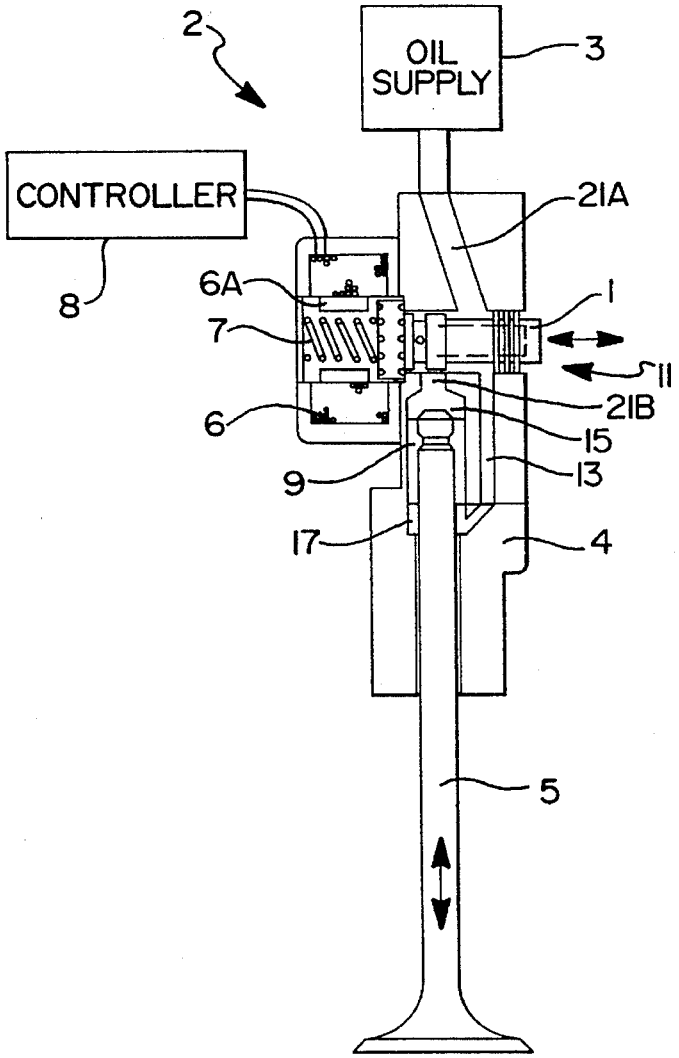
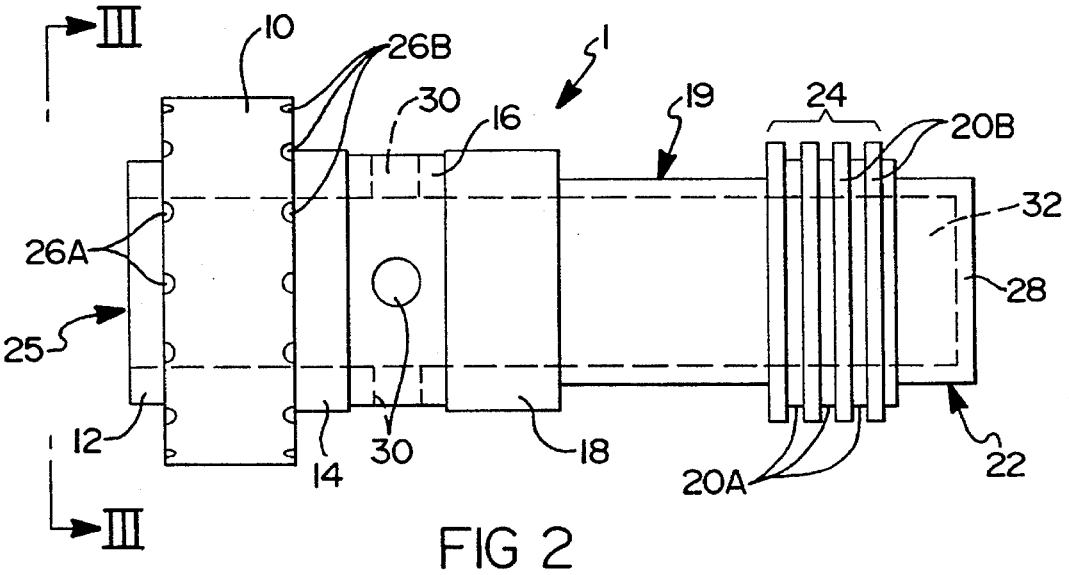
FIG 2

FIG 3
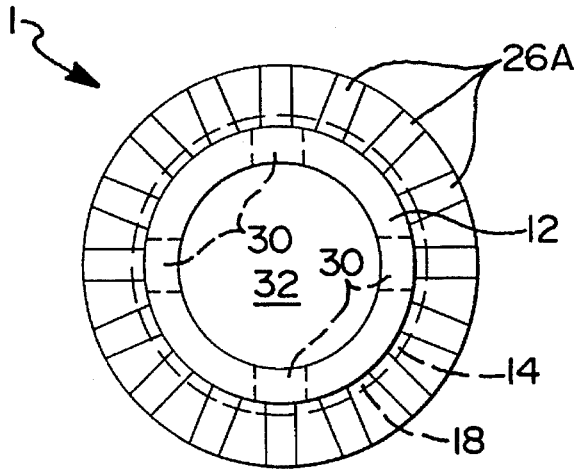
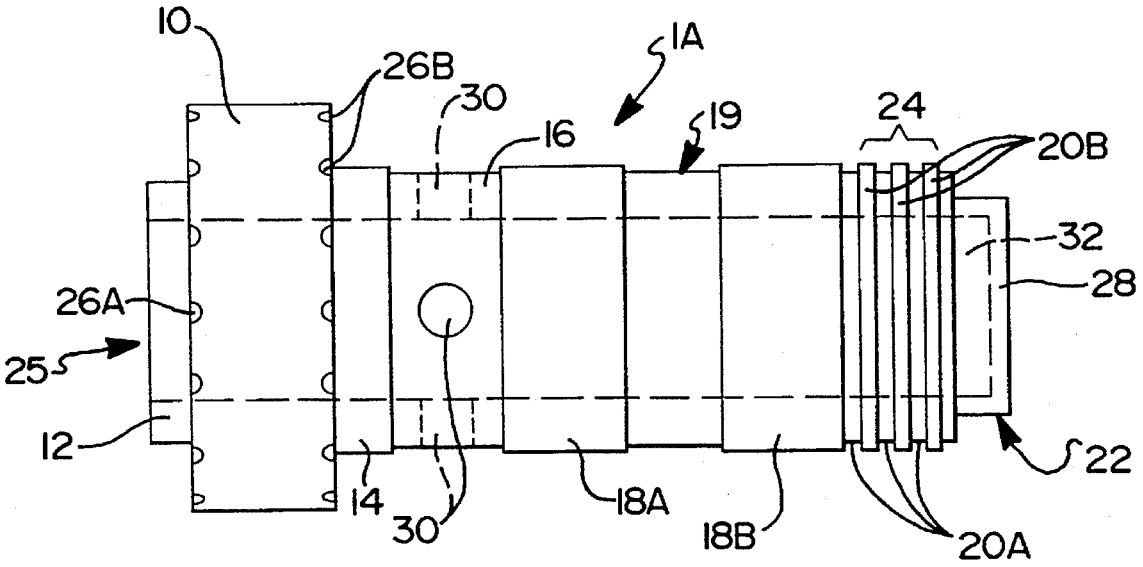
FIG 4

ENGINE HYDRAULIC VALVE ACTUATOR SPOOL VALVE

BACKGROUND OF THE INVENTION

1. Field of the Invention

The present invention relates to a spool valve for a hydraulic valve actuator for an engine. More specifically, the present invention relates to a spool valve for a hydraulic valve actuator for an engine having a lightweight construction for a high speed of response.

2. Description of the Prior Art

It is well known in the prior art to utilize a spool valve to control the flow of high pressure hydraulic oil to a cavity containing a piston. This method of controlling the flow of hydraulic oil minimizes the response time required by minimizing friction and the distance required for opening and closing hydraulic porting. The material used for the hydraulic spool valve can be and has traditionally been a steel or aluminum metal with a homogeneous metallurgical construction. The problem with a lightweight aluminum spool valve is that the material tends to gall if excess friction or wear is encountered in any part of an operating bore and its nonmagnetic property does not lend itself to magnetic actuation. A steel material has enhanced anti-galling properties, however, the material density is high resulting in a high overall weight for the valve which must be axially moved at a high rate of acceleration by an actuator. The relatively high weight of the steel spool valve results in a slower response time and a larger actuator must be used with high power consumption and increased size.

Another problem with the prior art has been due to the phenomena known as "stiction" which occurs when a hydraulic film acts between two relatively close surfaces to resist motion between the surface in any direction. The surface tension of the oil film causes a relatively high shear force which resists motion of the spool valve. Prior art spool valves have encountered actuation delay due to the stiction phenomena. One solution has been to form pockets in a surface of the spool valve that reacts with the valve bore which are commonly called castellation channels. The castellation channels reduce the stiction by changing the characteristics of the hydraulic interface between the spool valve and the valve bore in the actuator body.

Another problem here-to-date with prior art spool valves has been in the balancing of hydraulic pressure that the spool valve is subjected to when controlling the flow of high pressure hydraulic oil. Unbalanced hydraulic forces can result in unwanted motion of the spool valve resulting in undesired actuator travel.

SUMMARY OF THE INVENTION

The present invention provides for a lightweight hydraulic spool valve having a relatively fast response while providing for reduced friction and direct magnetic actuation through the use of a soft iron magnetic ring with castellation channels formed therein. Sections of the body of the spool valve are fabricated from lightweight materials such as aluminum, magnesium, titanium, or ceramics which are bonded to other sections of the main body of the spool valve, or in the alternative, made of one continuous material. One section of the main body provides for support of the magnetic ring which rides in the valve bore in the actuator body and magnetically interacts with an electrical coil against a return spring.

The present invention provides for balancing of the hydraulic forces encountered when controlling the motion of an actuator using a spool valve where one end of the spool valve is blocked using a plug.

BRIEF DESCRIPTION OF THE DRAWINGS

FIG. 1 is a cross-sectional view of a hydraulic engine valve actuator which includes the spool valve of the present invention;

FIG. 2 is an elevational side view of the spool valve of the present invention;

FIG. 3 is an elevational end view taken along line III—III of FIG. 2 of the spool valve of the present invention; and FIG. 4 is an elevational side view of an alternate embodiment of the spool valve of the present invention.

DETAILED DESCRIPTION OF THE PREFERRED EMBODIMENT

In this disclosure, certain terminology will be used for convenience and reference only and will not be limiting. For example, the terms "rightward" and "leftward" will refer to directions in the drawings in connection with which the terminology is used. The terms "inwardly" and "outwardly" will refer to directions toward and away from, respectively, the geometrical center of the apparatus being described. The terms "upward" and "downward" will refer to directions as taken in the drawings in connection with which the terminology is used. All foregoing terms include the normal derivatives and equivalents thereof.

Now referring to the drawings, FIG. 1 is a side cross-sectional view of a hydraulic valve actuator 2 which utilizes the spool valve 1 of the present invention. This configuration is known in the art as a three-way valve. The valve actuator 2 uses high pressure oil from oil supply 3 which is routed to the actuator main housing 4 and is routed and its flow is controlled by the axial position of the spool valve 1 which acts upon piston 9 which in turn forces an engine valve 5 open and closed in a very rapid manner. The spool valve 1 of the present invention is axially shifted to the left and right within valve bore 11 at the command of a controller 8 which generates an electrical signal. A return spring 7 forces the spool valve I to the right and the magnetic action of an electrical coil 6 which is electrically energized by the controller 8 acts to shift the spool valve 1 to the left.

When the spool valve 1 is driven to the left position by the coil 6, the spool valve 1 opens the high pressure oil from the oil supply 3 which is then fed through oil port 21A to the upper piston cavity 15 past the activated spool valve 1 and through hydraulic port 21B which forces the engine valve 5 open. High pressure oil is also routed to oil passageway 13 which routes oil to the lower piston cavity 17. The difference in the area on top of the piston 9 verses the area on the bottom of the piston 9 causes a large unbalanced force which drives the piston 9 and the attached engine valve 5 downward.

The spool valve 1 is returned by the bias spring 7 to a position to the right, when the controller terminates the excitation current to the electrical coil 6, the upper piston cavity 15 is vented through the spool valve 1 to atmosphere which releases the high pressure oil in the upper piston cavity 15. The high pressure oil supplied to the lower piston cavity 17 causes the piston 9 to move upward thereby causing the engine valve 5 to move upward and close.

Variation on this operational and structured description are envisioned such as when a four-way valve is used to control the flow of oil from the lower piston cavity 17 where the lower piston cavity 17 can be vented to atmosphere when the valve 5 is opened to provide additional force such as is needed when opening an exhaust valve against engine cylinder pressure.

Now referring to both FIGS. 1 and 2 of the drawings, a side elevational view of the spool valve assembly 1 of the present invention is shown in FIG. 2. As described with reference to FIG. 1, the spool valve 1 of the present invention is used to control the flow of high pressure hydraulic oil for use in activating an engine valve 5 according to commands received from the controller 8 which supplies electrical current to the electrical coil 6 which magnetically attracts a magnetic ring 10 which is positioned on shank section 12 adjacent to a first sealing section 14 of the spool valve 1. Thus, the axial position of the spool valve 1 is controlled by the magnetic interaction between the electrical coil 6 and the magnetic ring 10 and by the return spring 7. The magnetic ring 10 is made of a magnetically reactive material such as soft iron which may or may not be magnetized, and is attached to the spool valve body 25 by a suitable fastening means such as a press fit, adhesive or using a securing pin. The first sealing section 14 is attached to a flow port section 16 which, when moved in alignment with a high pressure hydraulic port, allows the hydraulic oil flow from one side of the flow port section 16 to a center bore 32 which vents to atmosphere through the side holding the magnetic ring 10.

The flow control section 18 of the spool valve 1 is typically the same diameter as the first sealing section 14 both of which are used to seal the hydraulic oil by maintaining a tight diametrical clearance (typically 0.0002 inches). The first sealing section 14 and the actuator valve bore 11 of the valve actuator 2 is a close precision fit and likewise, the diameter of the flow control section 18 is a close fit with the actuator valve bore 11. Sealing lands 20B are likewise sized for a close clearance, typically 0.0002 inches diametrical clearance, within the actuator valve bore 11 formed in the valve actuator 2 by keeping the spool valve 1 centered in the valve bore 11 using the centering grooves 20A to help distribute the high pressure oil around the periphery of the spool valve 1. The centering grooves 20A and the sealing lands 20B combine to comprise a second sealing section 24 which prevents the migration of the high pressure hydraulic oil outside of the valve actuator 2. A bridge section 19 joins the second sealing section 24 to the flow control section 18. High pressure oil from oil port 21A surrounds the bridge section 19 since it has a smaller outside diameter than the valve bore 11. An extension section 22 attached to and extending from the second sealing section 24 is optional. Balance plug 28 seals off the center bore 32 and serves to balance the high pressure hydraulic flow forces so that inadvertent movement of the spool valve 1 is minimized.

The spool valve 1 of the present invention can be fabricated from a variety of lightweight and magnetically inactive and active materials in order to optimize the performance of the spool valve 1 when installed in the hydraulic valve actuator 2. The ring 10 is commonly made up of magnetic reactive soft iron and is pressed or otherwise secured on the shank section 12 adjacent to the first sealing section 14 so that the spool valve 1 can be axially moved upon the introduction of a magnetic field created by an electrical current moving through electrical coil 6 surrounding the ring 10 in a traditional fashion. The magnetic field induced by coil 6 draws the ring 10 into the field against the coil armature ring 6A thereby moving the spool valve 1 leftward against the force created by the return spring 7 which tends to force the spool valve 1 to the right.

The ring 10 has a plurality of castellation channels 26A and 26B formed on, respectively, a leftward and rightward face thereof. The castellation channels 26A and 26B function to reduce the forces necessary to axially move the spool valve 1 when the ring 10 is positioned against the coil armature ring 6A or the actuator main housing 4 respectively. A "stiction force" is created when a thin film of hydraulic fluid resides between the ring 10 and another parallel flat surface such as the actuator main housing 4 or the coil armature ring 6A which can significantly slow the response of the spool valve 1. The castellation channels 26A and 26B are utilized to reduce this force and allow the spool valve 1 to easily move leftward upon energization of the coil 6 and return upon de-energization of the coil 6.

The first sealing section 14 can be fabricated from a lightweight material such as aluminum, magnesium, titanium, or ceramic which is then bonded to the flow port section 16 which can likewise be made of the same or a different type of lightweight material to optimize performance characteristics. Likewise, the flow control section 18 can be bonded to the flow port section 16 and fabricated of a lightweight nonmagnetic material such as aluminum, magnesium, titanium, or ceramic for reduction in the coefficient friction and desirable wear characteristics when operating in the valve bore 11 of the hydraulic valve actuator 2. In a similar manner, the extension section 22 can be fabricated of a lightweight material as mentioned previously. For example, the first sealing section 14 and the flow control section 18 and the second sealing section 24 could be made of a ceramic material for its enhanced wear characteristics when operating in an aluminum valve bore 11 while the extension section 22 and the flow port section 16 could be made of a lightweight material which is bonded to the ceramic sections. In an alternate embodiment, the ring 10 could be bonded to a flat face formed on the first sealing section 14 rather than having a center hole therethrough which is pressed on the shank section 12.

The shank section 12 and first sealing section 14 and flow port section 16 and flow control section 18 and bridge section 19 and second sealing section 24 and extension section 22 combine to make up the spool body 25 on which the magnetic ring 10 is attached. The spool body 25 can be made of one homogeneous lightweight material, such as aluminum, which can be anodized and/or coated for low friction and enhanced wear characteristics while the ring 10 must be made of a magnetic material such as soft iron.

The flow port section 16 is pierced by a plurality of hydraulic oil ports 30 which communicate to a center bore 32. The center bore 32 extends axially through the spool valve 1 and can be blocked at one end by balance plug 28 if the hydraulic flow forces combine to tend to move the spool valve 1 leftward while the coil 6 is de-energized and the return spring 17 is moving it rightward to vent the high pressure oil reading in the upper piston cavity 15 through the oil ports 30. The purpose of the balance plug 28 is to balance the hydraulic flow forces during the engine valve 5 closing cycle such that the spool valve 1 is not inclined to unintentionally open to high pressure 21 unless the coil 6 is energized and motion is desired.

Now referring to FIG. 3, an elevational end view taken along line III—III of FIG. 2 of the spool valve 1 of the present invention is shown. The castellation channels 26A are shown extending from the outer periphery of the ring 10 to the inner periphery of the ring 10 thereby channeling hydraulic fluid from one side of the ring 10 to the other side with the effect of reducing stiction between the spool valve 1 and the actuator main housing 4 when the spool valve 1 is in a rightward position as shown in FIG. 1. Also shown are four hydraulic oil ports 30 which extend to allow hydraulic communication between the outside of the flow area section 16 to the center bore 32 as discussed previously.

The centering grooves 20A are designed to center the valve assembly 1 in the valve bore 11 in the hydraulic valve actuator 2 thereby improving the sealing of the high pressure hydraulic fluid and allowing for the improved axial motion response of the spool valve 1 of the present invention. The plurality of centering grooves 20A and the sealing lands 20B make up the second sealing section 24 where the surface of the sealing lands 20B could be treated with an anti-friction and anti-wear type of treatment such as titanium nitride or anodizing assuming the sealing lands 20B are fabricated from aluminum. Teflon®, a polytetrafiorocarbon from DuPont, can be used to coat any surface to reduce friction and wear. These friction modifiers and/or wear enhancements can be combined to improve the overall performance of the spool valve 1 and can also be applied to other areas of the spool valve 1 if so desired.

The shank section 12 functions to provide support for the magnetic ring 10 and provides a surface for the magnetic ring 10 to be pressed on for support. The ring 10 is held by a precision press fit on the reduced diameter shank section 12 which extends from the first sealing section 14. Other methods can be used to retain the ring 10 in position on the spool body 25.

The function of the spool valve 1 of the present invention is to move axially within the actuator bore 11 formed in the hydraulic valve actuator 2 to control the flow of high pressure hydraulic fluid introduced on one side of the spool valve 1 through oil port 21A. The first sealing section 14 and the flow control section 18 combine to seal one or more hydraulic oil ports 21B formed in the hydraulic valve actuator 2 where the ports 21B lead into the operating valve bore 11 in which the spool valve 1 operates. The spool valve 1 is axially forced into position by a return spring 7 in one direction and the magnetic action of the coil 6 surrounding the magnetic ring 10 in the opposite direction. A controller 8 sends an electrical signal current to the coil 6 which in turn creates a magnetic field that causes the magnetic ring 10 to move axially to the left thereby causing the flow control section 18 to cover or uncover the hydraulic ports 21B formed in the hydraulic valve actuator 2. The flow control section 18 also moves rightward so as to open the upper piston cavity 15 to the flow port section 16 which opens to atmosphere. This allows the piston 9 to move upward and close the valve 5.

Now referring to FIG. 4, an elevational side view of an alternate embodiment of the present invention is shown. In this embodiment, a first and second flow control section 18A and 18B respectively are formed on a spool valve 1A which are used to cover and uncover respective high pressure supply ports similar to that shown in FIG. 1 as port 21. In this manner, what is known in the art as a four-way hydraulic valve operation can be created. Construction of spool valve 1A is similar to that described previously for spool valve 1. The extension section 22 has been reduced in length and the bridge section 19 joins the first flow control section 18A to the second flow control section 18B.

In operation, the first flow control section 18A opens an appropriate port to admit high pressure oil to the upper piston cavity 15 (see FIG. 1) while the second flow control section 18B opens another appropriate port (not shown in FIG. 1) to open the lower piston cavity 17 to atmosphere to increase the differential pressure acting on the piston 9 as compared to the three-way valve shown in FIG. 1. The four-way type valve (not shown) is used on an engine exhaust valve to create a high initial force since the exhaust valve must be forced open against exhaust cylinder pressure unlike an engine intake valve.

The description above refers to particular embodiments of the present invention and it is understood that many modifications may be made without departing from the spirit thereof. The embodiments of the invention disclosed and described in the above specification and drawings are presented merely as examples of the invention. Other embodiments, materials, forms and modifications thereof are contemplated as falling within the scope of the present invention only limited by the claims as follows.

I claim:

1. A spool valve operating within a valve bore in an engine hydraulic valve actuator comprising:

a cylindrical valve bore formed in said engine hydraulic valve actuator, said valve bore having a plurality of flow ports extending therefrom;

a magnetically reactive ring, said ring having opposed first and second faces, said second face having a plurality of radially extending castellation grooves formed therein;

an electric coil for creating a magnetic field to cause said ring to become displaced;

an annular first sealing section joined to said ring, said first sealing section having an outer peripheral surface disposed in relatively close proximity to said valve bore;

a flow port section joined to said first sealing section and vented to a relatively low pressure source, said flow port section having at least one oil port radially extending inward from an outer surface of said flow port section to a center bore, said center bore axially extending from a first end of said spool valve to a second end of said spool valve;

an annular flow control section joined to said flow port section, said flow control section having an outer peripheral surface in relatively close proximity to said valve bore to hydraulically seal at least one of said flow ports when said spool valve is in a first position, and to allow the flow of oil when said spool valve is in a second position;

an annular second sealing section joined to said flow control section by a bridge section, said second sealing section having an outer peripheral surface disposed in relatively close proximity to said valve bore.

2. The spool valve of claim 1 further comprising a cylindrical shank section joined to said first sealing section on which said ring is supported.

3. The spool valve of claim 1, wherein said center bore is open at said first end and sealed at said second end, said second sealing section being disposed between said flow port section and said second end.

4. The spool valve of claim 3, further comprising a balance plug disposed at said second end for sealing said second end.

5. The spool valve of claim 1, wherein said second sealing section is comprised of a plurality of sealing bands each separated from the other by a center groove for balancing hydraulic forces on said spool valve.

6. A spool valve operating within a valve bore in an engine hydraulic valve actuator comprising:

a cylindrical valve bore formed in said engine hydraulic valve actuator, said valve bore having a plurality of flow ports extending therefrom;

a magnetically reactive ring, said ring having opposed first and second faces, said second face having a plurality of radially extending castellation grooves formed therein;

an electric coil for creating a magnetic field to cause said ring to become displaced;

an annular first sealing section joined to said ring, said first sealing section having an outer peripheral surface disposed in relatively close proximity to said valve bore;

a flow port section joined to said first sealing section and vented to a relatively low pressure source, said flow port section having at least one oil port radially extending inward from an outer surface of said flow port section to a center bore, said center bore axially extending from a first end of said spool valve to a second end of said spool valve;

an annular first flow control section joined to said flow port section, said flow control section having an outer peripheral surface in relatively close proximity to said valve bore to hydraulically seal one or more of said flow ports when said spool valve is in a first position, and to allow the flow of oil when said spool valve is in a second position;

an annular second sealing section joined to said first flow control section by a bridge section, said second sealing section having an outer peripheral surface disposed in relatively close proximity to said valve bore;

an annular second flow control section joined to said first flow control section by said bridge section, said second flow control section having an outer peripheral surface in relatively close proximity to said valve bore to hydraulically seal at least one of said flow ports when said spool valve is in a first position and to allow the flow of oil when said spool valve is in a second position.

* * * * *